US010393117B2

(12) United States Patent
Ogata et al.

(10) Patent No.: US 10,393,117 B2
(45) Date of Patent: Aug. 27, 2019

(54) SCROLL COMPRESSOR

(71) Applicant: Panasonic Intellectual Property Management Co., Ltd., Osaka (JP)

(72) Inventors: Takeshi Ogata, Osaka (JP); Yusuke Imai, Shiga (JP); Sadayuki Yamada, Gunma (JP); Akihiro Hayashi, Shiga (JP); Atsushi Sakuda, Shiga (JP); Takashi Morimoto, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 82 days.

(21) Appl. No.: 15/117,447

(22) PCT Filed: Apr. 9, 2015

(86) PCT No.: PCT/JP2015/002007
§ 371 (c)(1),
(2) Date: Aug. 8, 2016

(87) PCT Pub. No.: WO2015/162869
PCT Pub. Date: Oct. 29, 2015

(65) Prior Publication Data

US 2016/0348676 A1 Dec. 1, 2016

(30) Foreign Application Priority Data

Apr. 24, 2014 (JP) ..... 2014-089745

(51) Int. Cl.
*F01C 17/06* (2006.01)
*F01C 21/00* (2006.01)
(Continued)

(52) U.S. Cl.
CPC ..... *F04C 18/0215* (2013.01); *F04C 18/0253* (2013.01); *F04C 23/02* (2013.01);
(Continued)

(58) Field of Classification Search
CPC ... F01C 17/066; F01C 21/003; F04C 29/0021
(Continued)

(56) References Cited

U.S. PATENT DOCUMENTS 4,431,388 A * 2/1984 Eber ..... F04C 14/065 417/295
5,102,316 A 4/1992 Caillat et al.
(Continued)

FOREIGN PATENT DOCUMENTS

CN 1670335 A 9/2005
EP 1762727 A2 3/2007
(Continued)

OTHER PUBLICATIONS

International Search Report of PCT application No. PCT/JP2015/002007 dated Jul. 14, 2015.
(Continued)

*Primary Examiner* — Deming Wan
(74) *Attorney, Agent, or Firm* — Hamre, Schumann, Mueller & Larson, P.C.

(57) ABSTRACT

A scroll compressor includes partition plate (20) that partitions an inside of sealed container (10) into high-pressure space (11) and low-pressure space (12), and fixed scroll (30) adjacent to partition plate (20). The scroll compressor includes orbiting scroll (40) that meshes with fixed scroll (30) to form compression chamber (50), rotation restrictor (90) that prevents rotation of orbiting scroll (40), and main bearing (60) that supports orbiting scroll (40). Fixed scroll (30), orbiting scroll (40), rotation restrictor (90), and main bearing (60) are disposed in low-pressure space (12), and fixed scroll (30) and orbiting scroll (40) are disposed between partition plate (20) and main bearing (60). The scroll compressor includes bearing coupler (102) provided in main bearing (60), scroll coupler (101) provided in fixed
(Continued)

scroll (30), and pillar member (100) having a lower end and an upper end, the lower end being inserted in bearing coupler (102) and the upper end being inserted in scroll coupler (101). A coupling region where pillar member (100) couples with scroll coupler (101) is in intersecting relationship with a horizontal plane positioned at a center of a scroll wrap height of fixed scroll (30).

5 Claims, 11 Drawing Sheets

(51) Int. Cl.
*F04C 29/00* (2006.01)
*F04C 18/02* (2006.01)
*F04C 23/02* (2006.01)

(52) U.S. Cl.
CPC ..... *F04C 29/0021* (2013.01); *F04C 2230/60* (2013.01); *F04C 2240/10* (2013.01); *F04C 2240/20* (2013.01); *F04C 2240/50* (2013.01); *F04C 2240/805* (2013.01)

(58) Field of Classification Search
USPC ..... 418/55.1–55.6
See application file for complete search history.

(56) References Cited

U.S. PATENT DOCUMENTS 5,489,198 A * 2/1996 Comparin ..... F01C 17/066 418/55.5
5,857,844 A * 1/1999 Lifson ..... F04C 18/0269 418/1
8,313,318 B2 * 11/2012 Stover ..... F04C 18/0215 417/299
2005/0201883 A1 9/2005 Clendenin et al.
2006/0233655 A1 * 10/2006 Clendenin ..... F01C 1/0215 418/55.1
2009/0101776 A1 * 4/2009 Peterson ..... F41G 11/001 248/205.1
2009/0297378 A1 12/2009 Stover et al.
2015/0004040 A1 1/2015 Katou et al.

FOREIGN PATENT DOCUMENTS

JP 4-103202 U 9/1992
JP 4-255586 9/1992
JP 7-158565 6/1995
JP 11-182463 7/1999
JP 2000-329078 11/2000
JP 2013-079643 5/2013

OTHER PUBLICATIONS

The Extended European Search Report dated Mar. 7, 2017 for the related European Patent Application No. 15782246.1, 8 pages.
English Translation of Chinese Search Report dated Dec. 26, 2017 for the related Chinese Patent Application No. 201580009422.8, 2 pages.
English Translation of Chinese Search Report dated Aug. 13, 2018 for the related Chinese Patent Application No. 201580009422.8.
English Translation of Chinese Search Report dated Nov. 12, 2018 for the related Chinese Patent Application No. 201580009422.8., 2 pages.
Yongzhang Yu et al: "Volumetric Compressor Technical Manual", published on Nov. 30, 2000, 6 pages.

* cited by examiner

SCROLL COMPRESSOR

CROSS-REFERENCE TO RELATED APPLICATIONS

This application is a U.S. national stage application of the PCT International Application No. PCT/JP2015/002007 filed on Apr. 9, 2015, which claims the benefit of foreign priority of Japanese patent application 2014-089745 filed on Apr. 24, 2014, the contents all of which are incorporated herein by reference.

TECHNICAL FIELD

The present invention relates to a scroll compressor.

BACKGROUND ART

In recent years, a sealed scroll compressor including a compressor unit and a motor unit has been known. In the sealed scroll compressor, the compressor unit includes a partition plate that partitions an inside of a pressure container into a low-pressure chamber and a high-pressure chamber, a fixed scroll and a orbiting scroll are provided in the low-pressure chamber, and the motor unit revolves the orbiting scroll. In the sealed scroll compressor, a boss of the fixed scroll is fitted in a securing hole of the partition plate. Refrigerant compressed in the compressor unit is discharged through a discharge port of the fixed scroll to the high-pressure chamber (for example, see Patent Literature 1).

In the sealed scroll compressor, the pressure around the compressor unit is low, so that the orbiting scroll and the fixed scroll are forced to separate from each other.

Hence, in many sealed scroll compressors, a tip seal is used to improve sealability of the compression chamber formed between the orbiting scroll and the fixed scroll.

Back pressure is preferably applied to the orbiting scroll or the fixed scroll to raise operational efficiency. A technique to improve sealability of the compression chamber, without using a tip seal, by applying back pressure to the fixed scroll to push the fixed scroll against the orbiting scroll is proposed (for example, see Patent Literature 2).

Such a technique, however, may result in overturn of the fixed scroll by gas pressure in the compression chamber.

CITATION LIST

Patent Literature

PTL 1: Unexamined Japanese Patent Publication No. H11-182463

PTL 2: Unexamined Japanese Patent Publication No. H4-255586

SUMMARY OF THE INVENTION

A scroll compressor according to the present invention includes a partition plate that partitions a sealed container into a high-pressure space and a low-pressure space, and a fixed scroll adjacent to the partition plate. The scroll compressor further includes a orbiting scroll that meshes with the fixed scroll to form a compression chamber, a rotation restrictor that prevents rotation of the orbiting scroll, and a main bearing that supports the orbiting scroll. The fixed scroll, the orbiting scroll, the rotation restrictor, and the main bearing are disposed in the low-pressure space. The fixed scroll and the orbiting scroll are disposed between the partition plate and the main bearing. The scroll compressor includes a bearing coupler provided in the main bearing, a scroll coupler provided in the fixed scroll, and a pillar member having a lower end inserted in the bearing coupler and an upper end inserted in the scroll coupler. A coupling region where the pillar member couples with the scroll coupler is in intersecting relationship with a horizontal plane positioned at a center of a scroll wrap height of the fixed scroll.

The scroll compressor according to the present invention can prevent the fixed scroll from overturning.

DESCRIPTION OF EMBODIMENT

An exemplary embodiment of the present invention will now be described below with reference to the drawings. The present invention is not limited to the exemplary embodiment described below.

Figure 1:
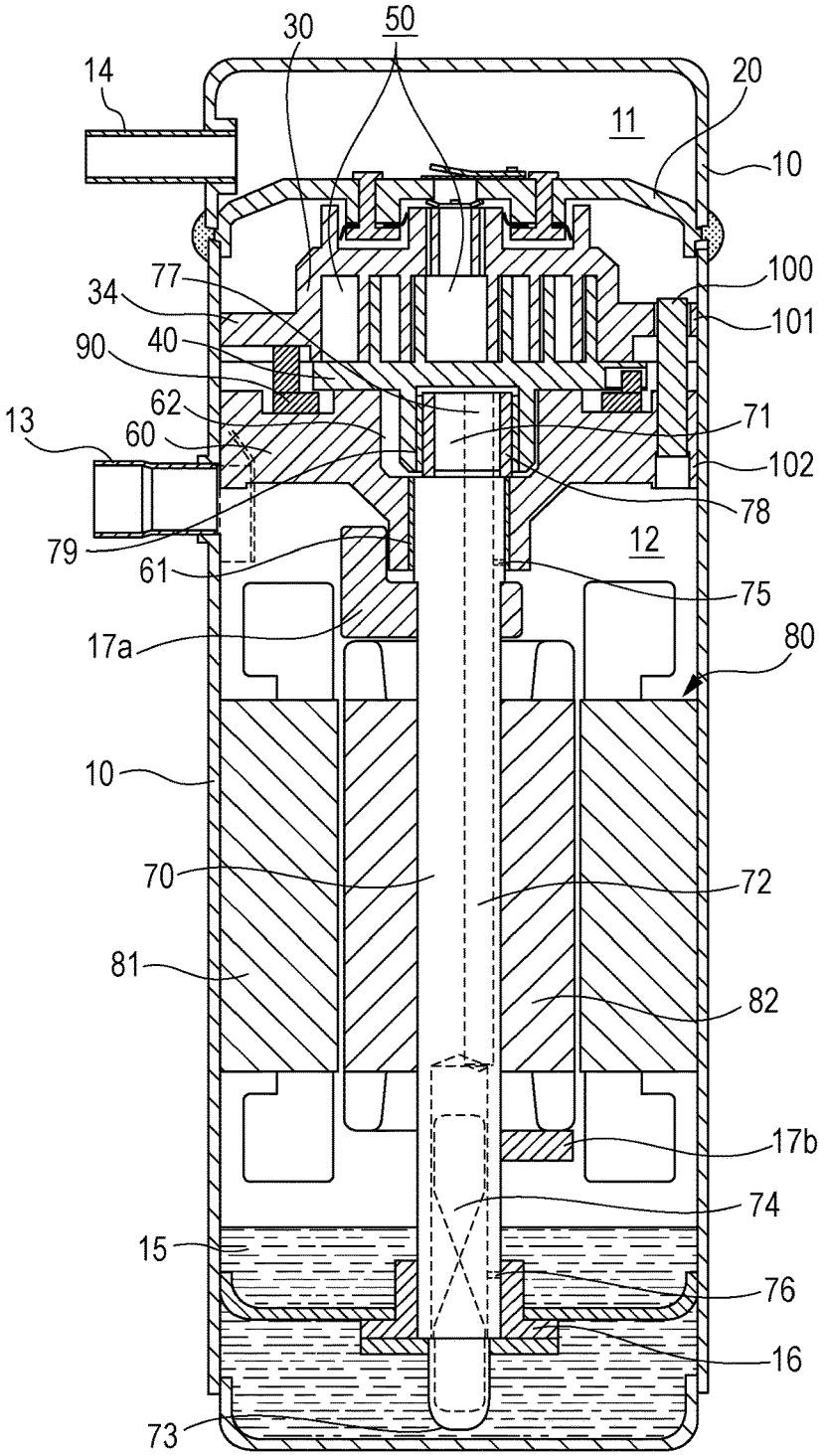
FIG. 1 is a longitudinal sectional view illustrating a configuration of a sealed scroll compressor according to an exemplary embodiment of the present invention.

FIG. 1 is longitudinal sectional view illustrating a configuration of a sealed scroll compressor according to an exemplary embodiment of the present invention. As illustrated in FIG. 1, the sealed scroll compressor includes sealed container 10 having a form of a vertically extending cylinder.

Partition plate 20 that partitions an inside of sealed container 10 into upper and lower parts is provided in an upper portion of sealed container 10. Partition plate 20 partitions the inside of sealed container 10 into high-pressure space 11 and low-pressure space 12.

Refrigerant suction tube 13 for introducing refrigerant into low-pressure space 12 and refrigerant discharge tube 14 for discharging the compressed refrigerant from high-pressure space 11 are provided in sealed container 10. Oil reservoir 15 where lubricating oil is accumulated is provided in a bottom portion of low-pressure space 12.

Fixed scroll 30 and orbiting scroll 40 serving as a compressor mechanism are provided in low-pressure space 12. Fixed scroll 30 is adjacent to partition plate 20. Orbiting scroll 40 meshes with fixed scroll 30 to form compression chamber 50.

Main bearing 60 that supports orbiting scroll 40 is provided below fixed scroll 30 and orbiting scroll 40. Bearing 61 and boss house 62 are provided approximately in a center of main bearing 60.

Bearing 61 rotatably supports a rotation shaft 70.

Bearing 61 and sub-bearing 16 support rotation shaft 70. Eccentric shaft 71 positioned to be eccentric from an axis of rotation shaft 70 is provided on the top end of rotation shaft 70.

Oil passage 72 through which the lubricating oil passes is provided inside rotation shaft 70. Suction port 73 for the lubricating oil is provided at a lower end of rotation shaft 70. Paddle 74 is provided above suction port 73. Oil passage 72 communicates with suction port 3 and paddle 74 and extends along an axial direction of rotation shaft 70. Oil passage includes oil supply port for supplying the lubricating oil to bearing 61, oil supply port 76 for supplying the lubricating oil to sub-bearing 16, and oil supply port 77 for supplying the lubricating oil to boss house 62.

Eccentric shaft 71 is inserted via swing bush 78 and revolve bearing 79 in boss house 62 in a manner allowed to revolve.

Stator 81 fixed to sealed container 10 and rotor 82 disposed in an inner side of stator 81 constitute motor unit 80.

Rotor 82 is fixed to rotation shaft 70. Balance weight 17*a* and balance weight 17*b* are attached to rotation shaft 70 respectively at portions above and below rotor 82. Balance weight 17*a* and balance weight 17*b* are separately positioned by 180 degrees about the axis of rotation shaft 70. Centrifugal forces acting on balance weights 17*a*, 17*b* balance with a centrifugal force generated by the revolution of orbiting scroll 40. Balance weights 17*a*, 17*b* may be fixed to rotor 82.

Rotation restrictor (oil dam ring) 90 prevents orbiting scroll 40 from rotating. Orbiting scroll 40 is supported by fixed scroll 30 via rotation restrictor 90. In this manner, orbiting scroll 40 revolves with respect to fixed scroll 30 without rotating.

Pillar member 100 hinders rotation and radial movement of fixed scroll 30 but allows an axial movement of fixed scroll 30. Fixed scroll 30 is supported by main bearing 60 via pillar member 100 in a manner allowed to move in an axial direction between partition plate 20 and main bearing 60.

Fixed scroll 30, orbiting scroll 40, motor unit 80, rotation restrictor 90, and main bearing 60 are disposed in low-pressure space 12. Fixed scroll 30 and orbiting scroll 40 are disposed between partition plate 20 and main bearing 60.

Rotor 82 and rotation shaft 70 rotate by driving motor unit 80. eccentric shaft 71 causes orbiting scroll 40 to revolve without rotating. By this motion, the refrigerant is compressed in compression chamber 50.

The refrigerant is introduced from refrigerant suction tube 13 into low-pressure space 12. The refrigerant in a circumferentially outer region of orbiting scroll 40 in low-pressure space 12 is introduced into compression chamber 50. The refrigerant is compressed in compression chamber 50 and then passes through high-pressure space 11 to be discharged from refrigerant discharge tube 14.

Rotating rotation shaft 70 causes the lubricating oil accumulated in oil reservoir 15 to enter oil passage 72 from suction port 73. The lubricating oil is pumped upward along paddle 74 in oil passage 72. The pumped-up lubricating oil is supplied to bearing 61, sub-bearing 16, and boss house 62 respectively from oil supply ports 75, 76, and 77. The lubricating oil pumped up to boss house 62 is guided along faces of main bearing 60 and orbiting scroll 40 sliding against each other and passes through return passage 63 (see FIG. 6) provided in main bearing 60 to return to oil reservoir 15.

Figure 2A:
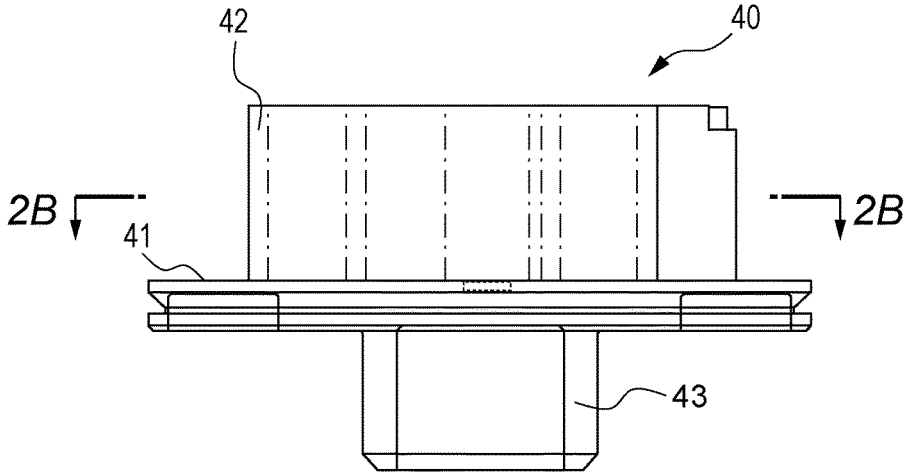
FIG. 2A is a side view of a orbiting scroll of the sealed scroll compressor according to the exemplary embodiment of the present invention.
Figure 2B:
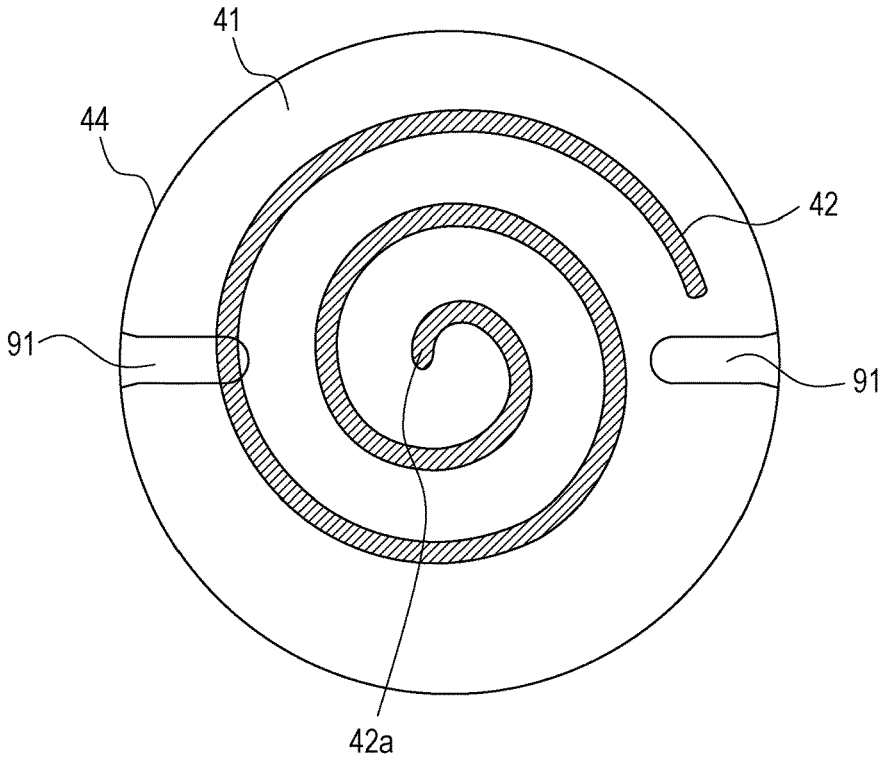
FIG. 2B is a sectional view taken along line 2B-2B in FIG. 2A.

FIG. 2A is a side view illustrating the orbiting scroll of the sealed scroll compressor according to the exemplary embodiment of the present invention. FIG. 2B is a sectional view taken along line 2B-2B in FIG. 2A.

Orbiting scroll 40 includes orbiting scroll plate 41 having a disk shape, orbiting scroll wrap 42 having a scroll shape and provided upright on orbiting scroll plate 41, and cylindrical boss 43 provided substantially in a center of a bottom face of orbiting scroll plate 41.

As illustrated in FIG. 2B, a pair of first key grooves 91 is formed in orbiting scroll plate 41.

Figure 3:
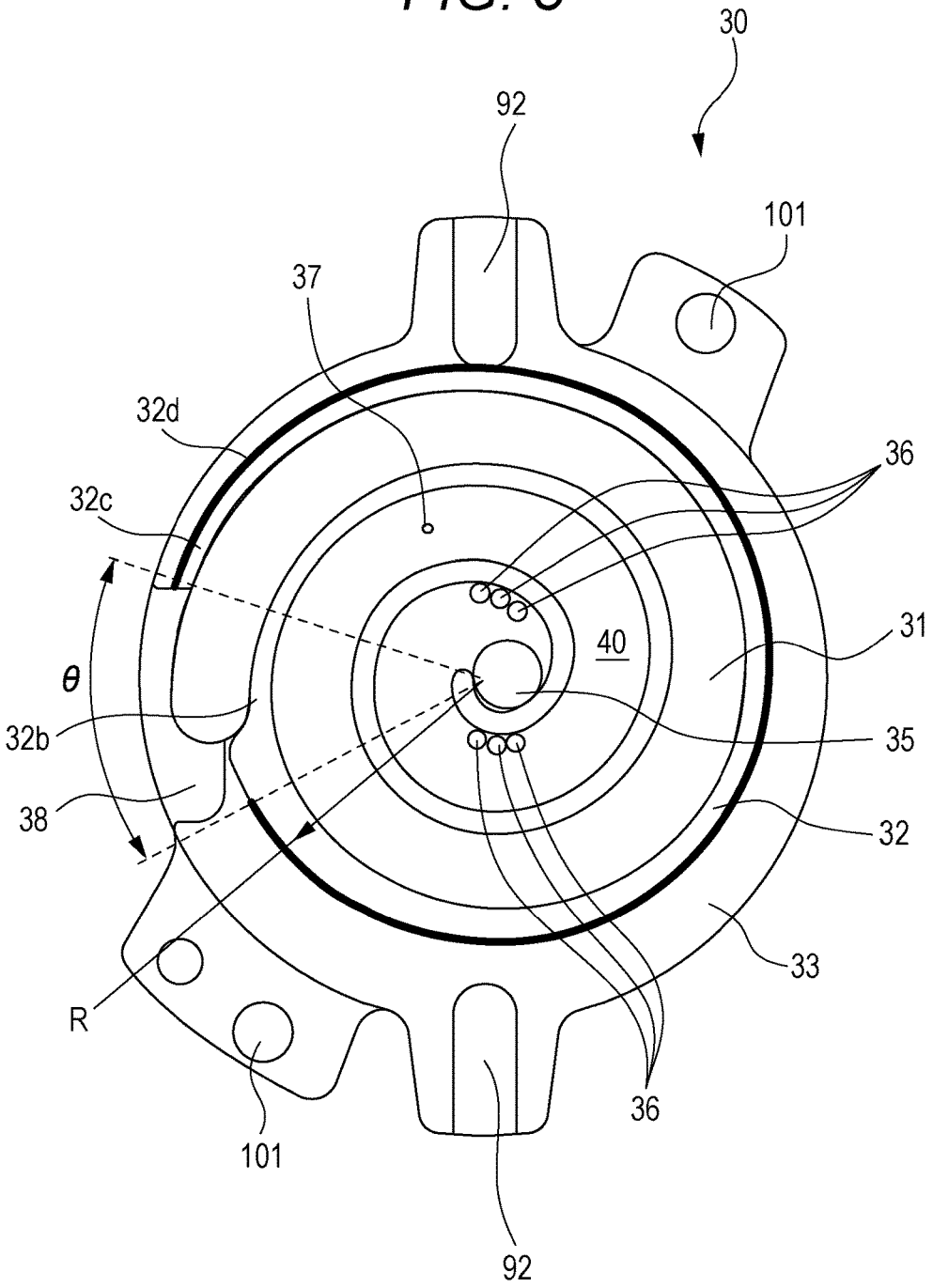
FIG. 3 is a bottom view illustrating a fixed scroll of the sealed scroll compressor according to the exemplary embodiment of the present invention.
Figure 4:
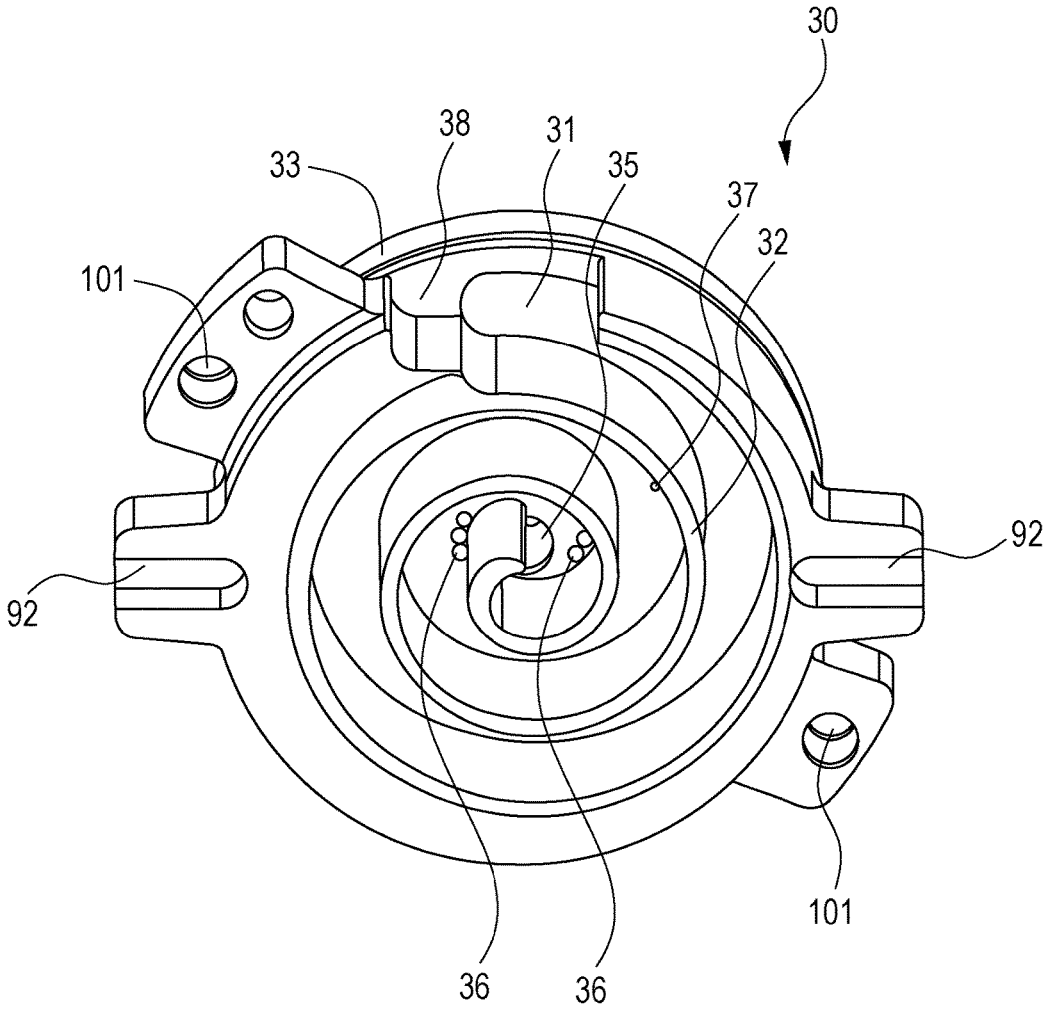
FIG. 4 is a perspective view of the fixed scroll of the sealed scroll compressor according to the exemplary embodiment of the present invention viewed from a bottom side.
Figure 5:
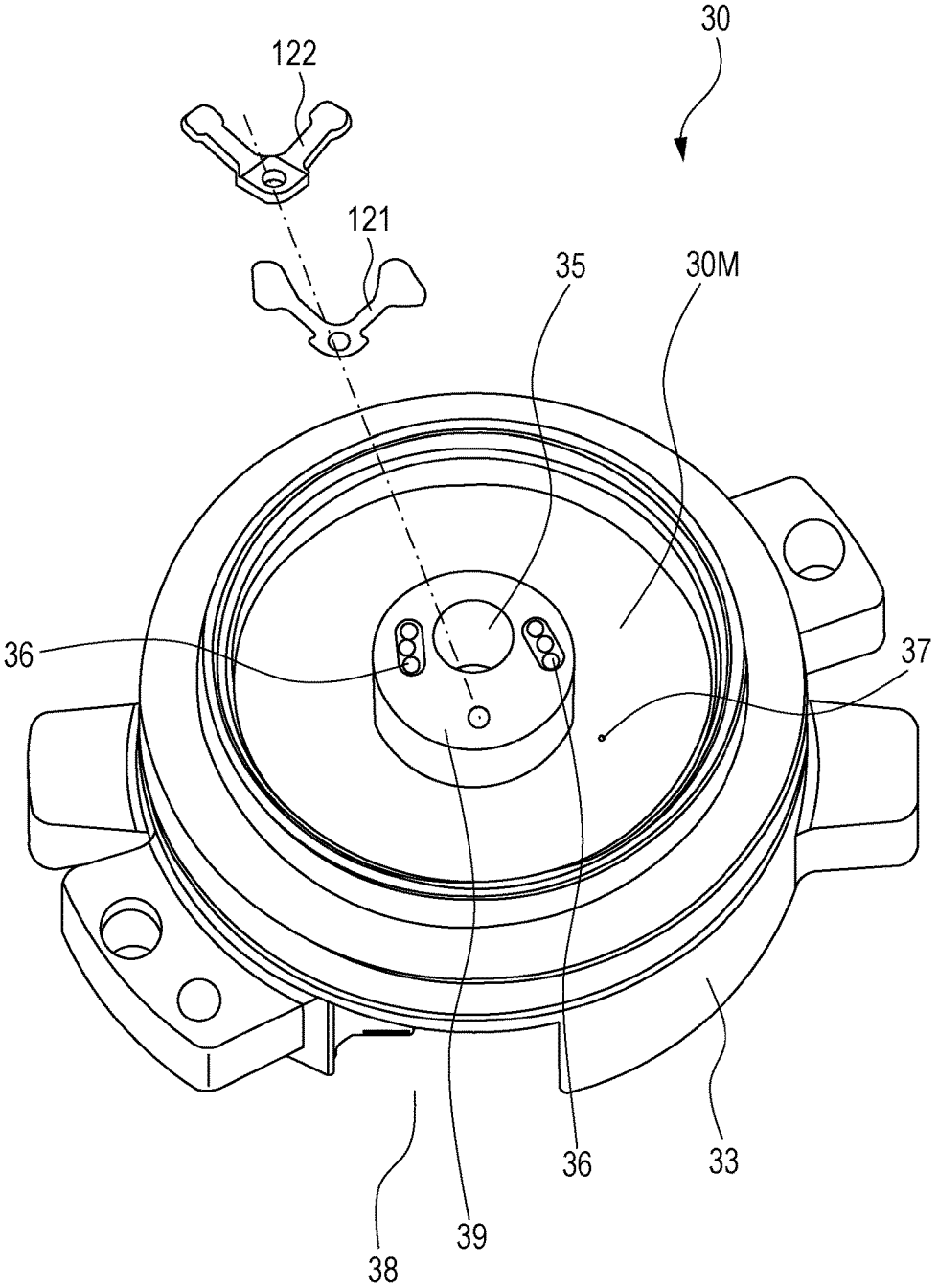
FIG. 5 is a perspective view of the fixed scroll of the sealed scroll compressor according to the exemplary embodiment of the present invention viewed from a top side.

FIG. 3 is a bottom view illustrating the fixed scroll of the sealed scroll compressor according to the exemplary embodiment of the present invention. FIG. 4 is a perspective view of the fixed scroll viewed from a bottom side. FIG. 5 is a perspective view of the fixed scroll viewed from a top side.

Fixed scroll 30 includes fixed scroll plate 31 having a disk shape, fixed scroll wrap 32 having a scroll shape and provided upright on a bottom face of fixed scroll plate 31, and circumferential wall 33 provided upright to surround a periphery of fixed scroll wrap 32.

An inner wall and an outer wall constitute fixed scroll wrap 32 at wall end 32*b*. From wall end 32*b*, fixed scroll wrap 32 is formed only by inner wall to further extend by approximately 340 degrees to outermost inner wall 32*c*.

First discharge port 35 is formed substantially in a center of fixed scroll plate 31. Fixed scroll plate 31 is provided with bypass port 36 and mid-pressure port 37. Bypass port 36 is located near first discharge port 35 in a high-pressure region where compression is almost completed. Mid-pressure port 37 is located in an intermediate pressure region where compression is still taking place Suction inlet 38 for taking the refrigerant into compression chamber 50 is provided in circumferential wall 33 of fixed scroll 30. Second key groove 92 is provided in a portion of circumferential wall 33.

Scroll coupler 101 in which the top end of pillar member 100 is inserted is provided in a portion of circumferential wall 33.

As illustrated in FIG. 5, boss 39 is provided in a center of the upper face of fixed scroll 30 (a face opposing partition plate 20). First discharge port 35 and bypass port 36 are provided in boss 39.

A ring shaped recess is provided between circumferential wall 33 and boss 39 in the upper face of fixed scroll 30 to form intermediate pressure space 30M. Mid-pressure port 37 is provided in the intermediate pressure space 30M. Mid-pressure port 37 has a diameter smaller than an inner wall thickness and an outer wall thickness of orbiting scroll wrap 42. The diameter of mid-pressure port 37 smaller than the inner wall thickness and the outer wall thickness of orbiting scroll wrap 42 prevents communication between compression chamber 50 in an inner wall side of orbiting scroll wrap 42 and compression chamber 50 in an outer wall side of orbiting scroll wrap 42.

Boss 39 is provided with bypass check valve 121 that can shut bypass port 36 and bypass check valve stopper 122. By using a reed valve as bypass check valve 121, a valve height can be kept suitably low. A V-type reed valve used as bypass check valve 121 can shut bypass port 36 communicating with compression chamber 50 in the outer wall side of orbiting scroll wrap 42 and bypass port 36 communicating with compression chamber 50 in the inner wall side of orbiting scroll wrap 42.

Figure 6:
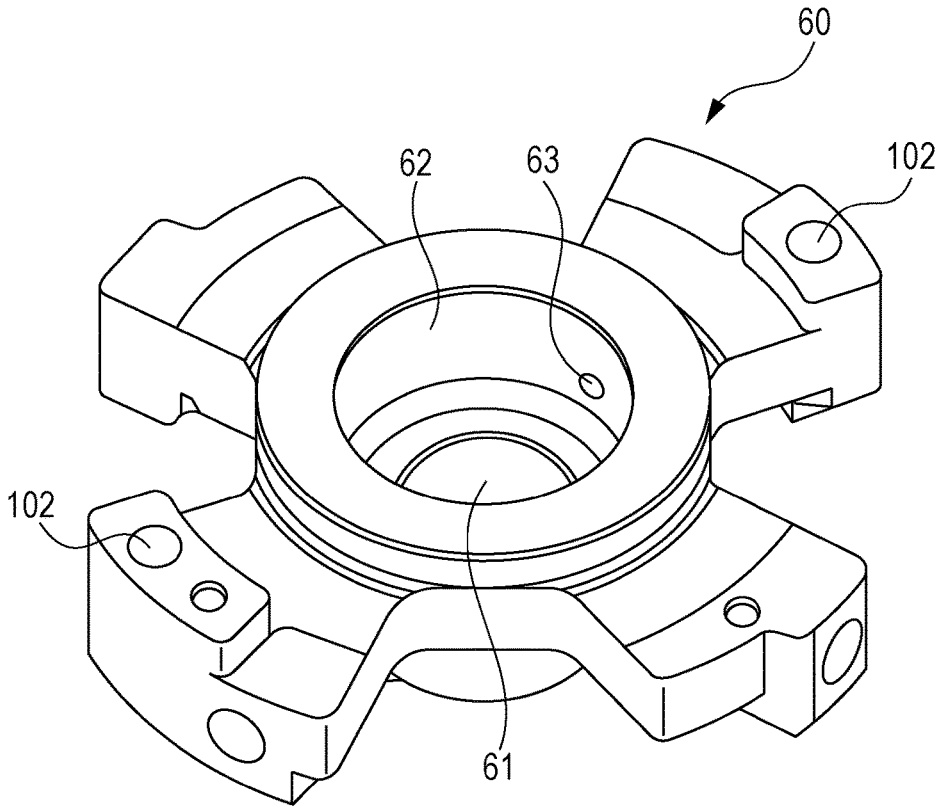
FIG. 6 is a perspective view of a main bearing of the sealed scroll compressor according to the exemplary embodiment of the present invention.

FIG. 6 is a perspective view illustrating the main bearing of the sealed scroll compressor according to the exemplary embodiment of the present invention.

Bearing 61 and boss house 62 are provided substantially in a center of main bearing 60.

Bearing coupler 102 in which the lower end of pillar member 100 is inserted is provided in an outer circumference of main bearing 60.

Return passage 63 is provided in main bearing 60 to communicate with boss house 62.

Figure 7:
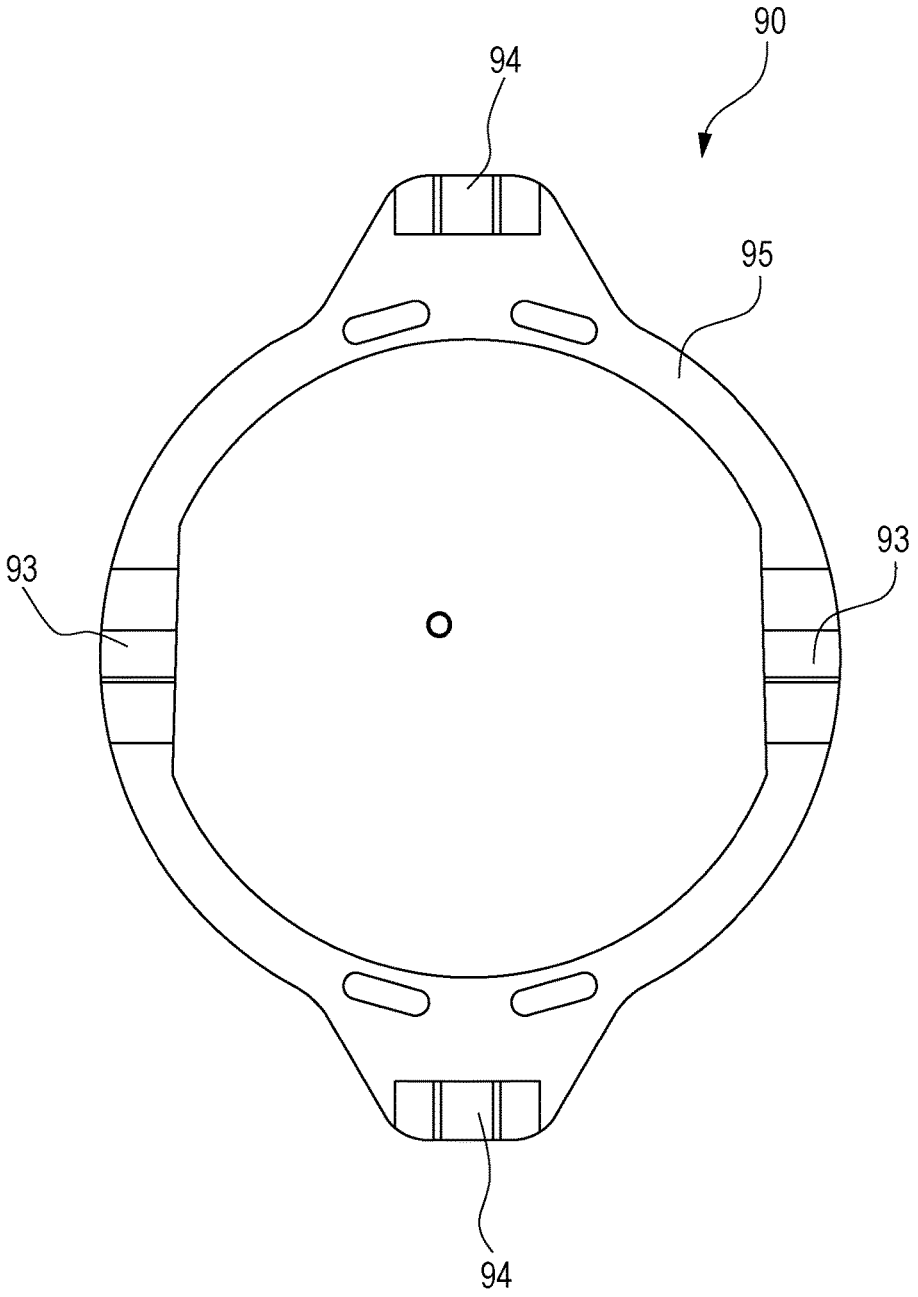
FIG. 7 is atop view illustrating a rotation restrictor of the sealed scroll compressor according to the exemplary embodiment of the present invention.

FIG. 7 is a top view illustrating the rotation restrictor of the sealed scroll compressor according to the exemplary embodiment of the present invention.

Rotation restrictor (oil dam ring) 90 is provided with first key 93 and second key 94. First key 93 engages with first key groove 91 of orbiting scroll 40. Second key 94 engages with second key groove 92 of fixed scroll 30. Thus, orbiting scroll 40 can revolve with respect to fixed scroll 30 without rotating. As illustrated in FIG. 1, fixed scroll 30, orbiting scroll 40, and oil dam ring 90 are arranged in order, with fixed scroll 30 in an uppermost, along the axial direction of rotation shaft 70. Since fixed scroll 30, orbiting scroll 40, and oil dam ring 90 are arranged in this order, first key 93 and second key 94 of oil dam ring 90 are provided on the same face of ring 95. First key 93 and second key 94 can thus be processed from the same direction when processing oil dam ring 90. The number of times taking off oil dam ring 90 from a processing tool can be reduced. Thus, processing accuracy can be improved and the processing cost can be reduced.

Figure 8:
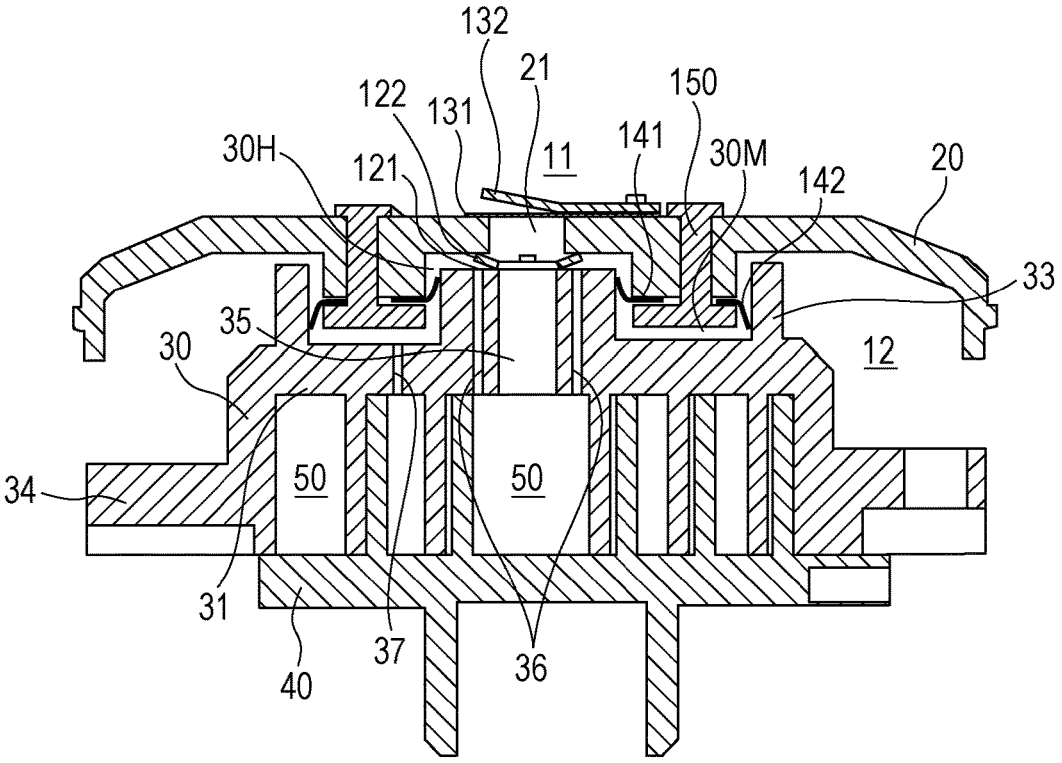
FIG. 8 is a sectional view of an essential portion illustrating a partition plate and the fixed scroll of the sealed scroll compressor according to the exemplary embodiment of the present invention.

FIG. 8 is a sectional view of an essential portion illustrating the partition plate and the fixed scroll of the sealed scroll compressor according to the exemplary embodiment of the present invention.

Second discharge port 21 is provided in a center of partition plate 20. Second discharge port 21 is provided with discharge check valve 131 and discharge check valve stopper 132.

Discharge space 30H communicating with first discharge port 35 is provided between partition plate 20 and fixed scroll 30. Discharge space 30H communicates via second discharge port 21 with high-pressure space 11. Discharge check valve 131 shuts second discharge port 21.

In the exemplary embodiment, high-pressure produced in discharge space 30H between partition plate 20 and fixed scroll 30 pushes fixed scroll 30 against orbiting scroll 40. The gap between fixed scroll 30 and orbiting scroll 40 is thus eliminated. Consequently, the sealed scroll compressor according to the exemplary embodiment can operate with high efficiency.

In the exemplary embodiment, bypass port 36, besides first discharge port 35, provides communication between compression chamber 50 and discharge space 30H, and bypass check valve 121 is provided at bypass port 36. In this manner, the refrigerant is prevented from flowing in the opposite direction from discharge space 30H and introduced into discharge space 30H by the pressure reaching a predetermined value. The sealed scroll compressor according to the exemplary embodiment can thus be operated with high efficiency throughout a wide operating range.

Discharge check valve 131 has a larger thickness than bypass check valve 121.

First discharge port 35 is given a smaller volume than second discharge port 21 to reduce loss in discharge pressure from compression chamber 50.

The loss in discharge pressure can be reduced by providing a taper at an inflow side of second discharge port 21.

The sealed scroll compressor according to the exemplary embodiment includes ring-shaped first seal 141 provided between partition plate 20 and fixed scroll 30 in an outer circumference of discharge space 30H. The sealed scroll compressor according to the exemplary embodiment includes ring-shaped second seal 142 provided between partition plate 20 and fixed scroll 30 in an outer circumference of first seal 141.

As a material of first seal 141 and second seal 142, for example, polytetrafluoroethylene, which is a fluorine resin, is suitable regarding sealing and assembly. Mixing fibrous material in a fluorine resin improves reliability of sealing of first seal 141 and second seal 142.

First seal 141 and second seal 142 are clamped between plugging member 150 and partition plate 20. By using plugging member 150 made of aluminum, plugging member 150 is swaged against partition plate 20.

Intermediate pressure space 30M is formed between first seal 141 and second seal 142. Intermediate pressure space 30M communicates via mid-pressure port 37 with an intermediate pressure region in compression chamber 50 where compression is still taking place. Therefore, the pressure in intermediate pressure space 30M is lower than the pressure in discharge space 30H but higher than the pressure in low-pressure space 12.

In the exemplary embodiment, intermediate pressure space 30M is provided, besides high-pressure discharge space 30H, between partition plate 20 and fixed scroll 30, so that a force pushing fixed scroll 30 against orbiting scroll 40 is easy to adjust.

In the exemplary embodiment, first seal 141 and second seal 142 constitute discharge space 30H and intermediate pressure space 30M. This reduces leakage of the refrigerant from high-pressure discharge space 30H to intermediate pressure space 30M as well as from intermediate pressure space 30M to low-pressure space 12.

In the exemplary embodiment, first seal 141 and second seal 142 are clamped between plugging member 150 and partition plate 20. first seal 141 and second seal 142 can thus be disposed inside sealed container 10 by assembling partition plate 20, first seal 141, second seal 142, and plugging member 150. This reduces a number of parts and allows the scroll compressor to be assembled easily.

Figure 9:
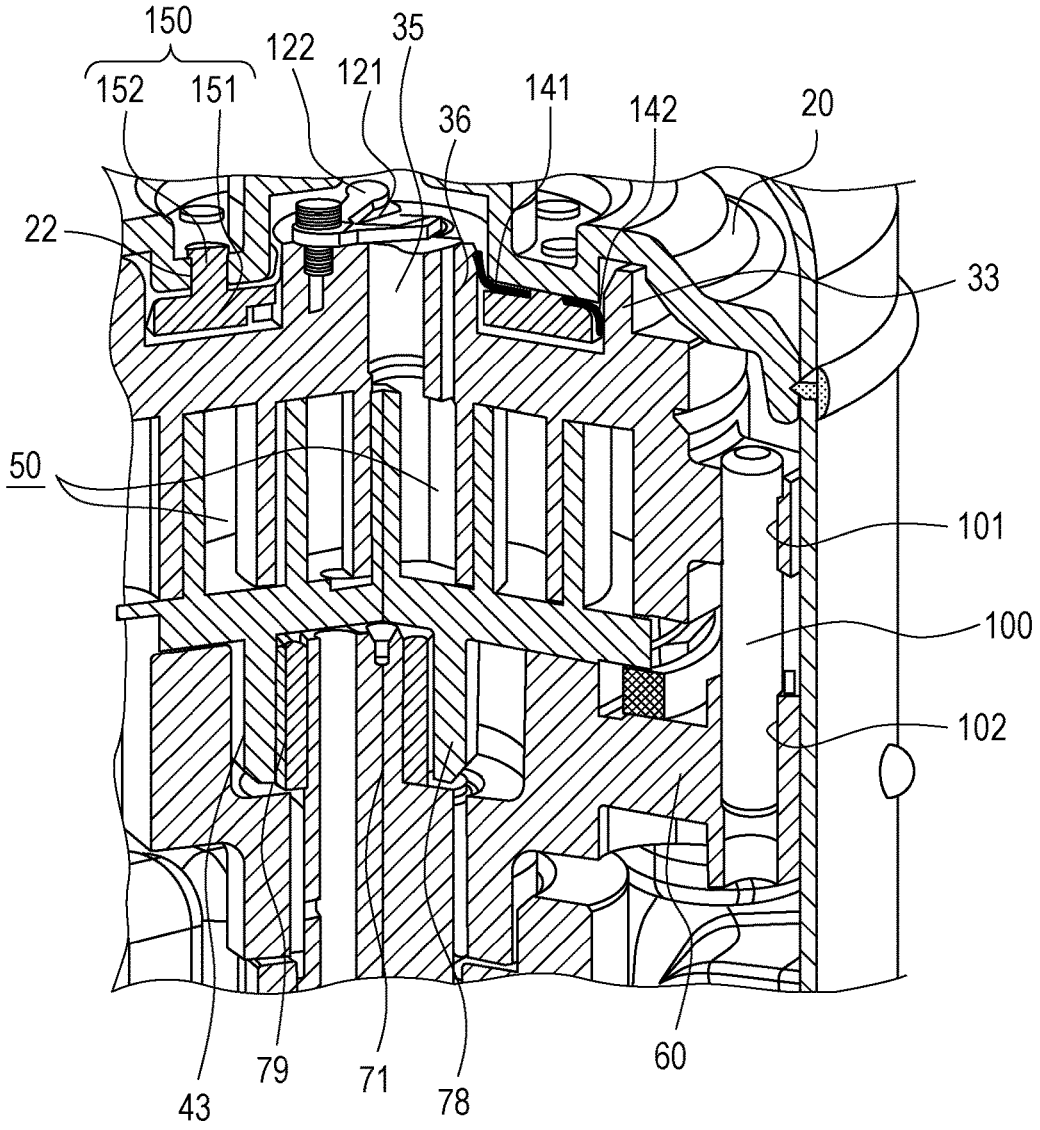
FIG. 9 is a perspective view illustrating an essential portion of the sealed scroll compressor according to the exemplary embodiment of the present invention.

FIG. 9 is a perspective view illustrating an essential portion of the sealed scroll compressor according to the exemplary embodiment of the present invention.

As illustrated in FIG. 9, plugging member 150 in FIG. 8 includes ring member 151 and a plurality of projections 152 provided on a face of ring member 151.

An outer circumference of first seal 141 is clamped between an inner circumferential upper face of ring member 151 and partition plate 20. An inner circumference of second seal 142 is clamped between an outer circumferential upper face of ring member 151 and partition plate 20

Ring member 151 is attached to partition plate 20 with first seal 141 and second seal 142 clamped between ring member 151 and partition plate 20.

Plugging member 150 is attached to partition plate 20 by inserting projections 152 in holes 22 provided in partition plate 20 and then, with ring member 151 pushed against a bottom face of partition plate 20, swaging the end of each of projections 152.

With plugging member 150 attached to partition plate 20, an inner circumference of first seal 141 projects into an inner circumference of ring member 151. The outer circumference of second seal 142 projects into an outer circumference of ring member 151.

By assembling partition plate 20, to which plugging member 150 is attached, in sealed container 10, the inner circumference of first seal 141 is pushed against an outer circumference of boss 39 of fixed scroll 30. The outer circumference of second seal 142 is pushed against an inner circumference of circumferential wall 33 of fixed scroll 30.

Figure 10:
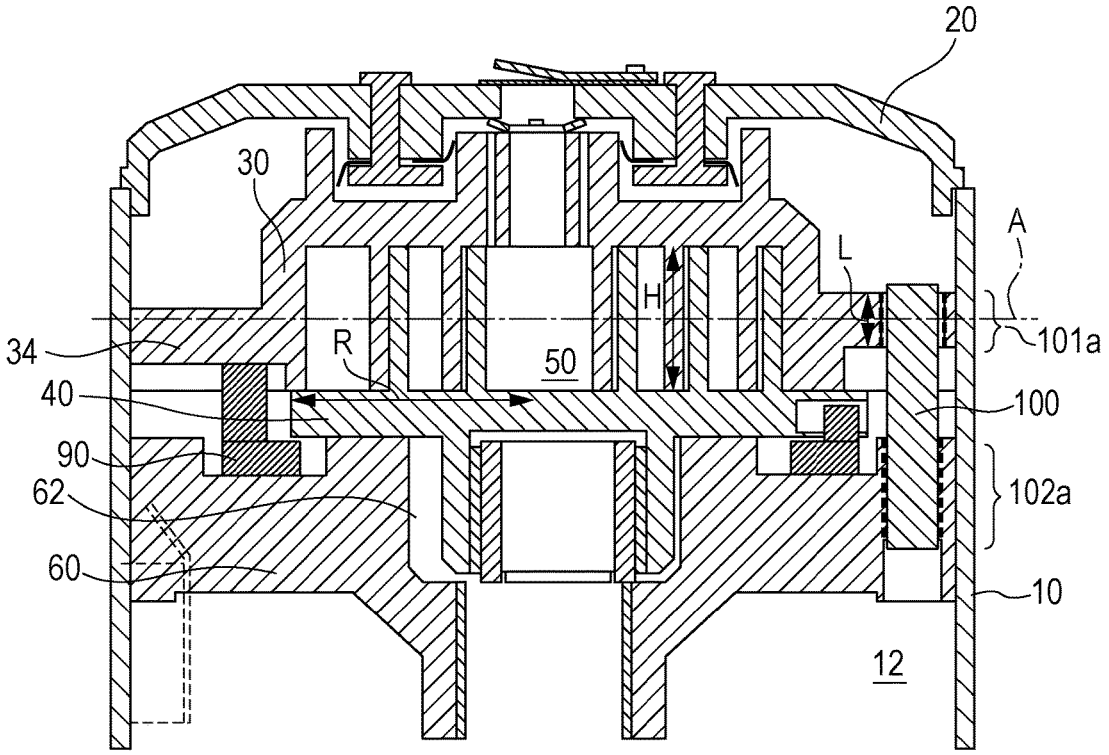
FIG. 10 is a longitudinal sectional view illustrating positional relationship between horizontal plane A positioned at a center of a scroll wrap height and a coupling region of the sealed scroll compressor according to the exemplary embodiment of the present invention.

FIG. 10 is a longitudinal sectional view illustrating positional relationship between horizontal plane A positioned at a center of a scroll wrap height and a coupling region of the sealed scroll compressor according to the exemplary embodiment of the present invention.

As illustrated in FIGS. 1 and 9, bearing coupler 102 is provided in the outer circumference of main bearing 60. Scroll coupler 101 is provided in fixed scroll 30.

The lower end of pillar member 100 is inserted in bearing coupler 102, and the upper end of pillar member 100 is inserted in scroll coupler 101.

In the exemplary embodiment, a height of fixed scroll wrap 32 of fixed scroll 30 is referred to as H.

The sealed scroll compressor according to the exemplary embodiment includes partition plate 20 partitioning the inside of sealed container 10 into high-pressure space 11 and low-pressure space 12, and fixed scroll 30 adjacent to partition plate 20. The sealed scroll compressor includes orbiting scroll 40 that meshes with fixed scroll 30 to form compression chamber 50, rotation restrictor 90 that prevents rotation of orbiting scroll 40, and main bearing 60 that supports orbiting scroll 40. Fixed scroll 30, orbiting scroll 40, rotation restrictor 90, and main bearing 60 are disposed in low-pressure space 12, and fixed scroll 30 and orbiting scroll 40 are disposed between partition plate 20 and main bearing 60. The sealed scroll compressor includes bearing coupler 102 provided in main bearing 60, scroll coupler 101 provided in fixed scroll 30, and pillar member 100 having the lower end and the upper end, the lower end being inserted in bearing coupler 102 and the upper end being inserted in scroll coupler 101. Coupling region 101*a* where pillar member 100 couples with scroll coupler 101 is in intersecting relationship with horizontal plane positioned at the center of the height of a scroll wrap, which is fixed scroll wrap 32 of fixed scroll 30. With this configuration, an axial distance between the center of height H of fixed scroll wrap 32 and coupling region 101*a* can be reduced, where a resultant of radial and tangential gas forces applied to fixed scroll 30 acts on the center of height and scroll coupler 101 of fixed scroll 30 receiving the resultant gas force and pillar member 100 form coupling region 101*a*. Therefore, a rotational moment acting in a direction to overturn fixed scroll 30 can be minimized. The overturn of fixed scroll 30 is thus prevented.

In the sealed scroll compressor according to the exemplary embodiment, the lower end of pillar member 100 and bearing coupler 102 are fixed together. The upper end of pillar member 100 and scroll coupler 101 are coupled together in an axially slidable manner. With this configuration, the resultant of radial and tangential gas forces applied to fixed scroll 30 is surely received at coupling region 101*a* formed by pillar member 100 and scroll coupler 101. Thus, the overturn of fixed scroll 30 can surely be prevented.

Bearing coupling region 102*a* is formed by bearing coupler 102 and pillar member 100.

Figure 11A:
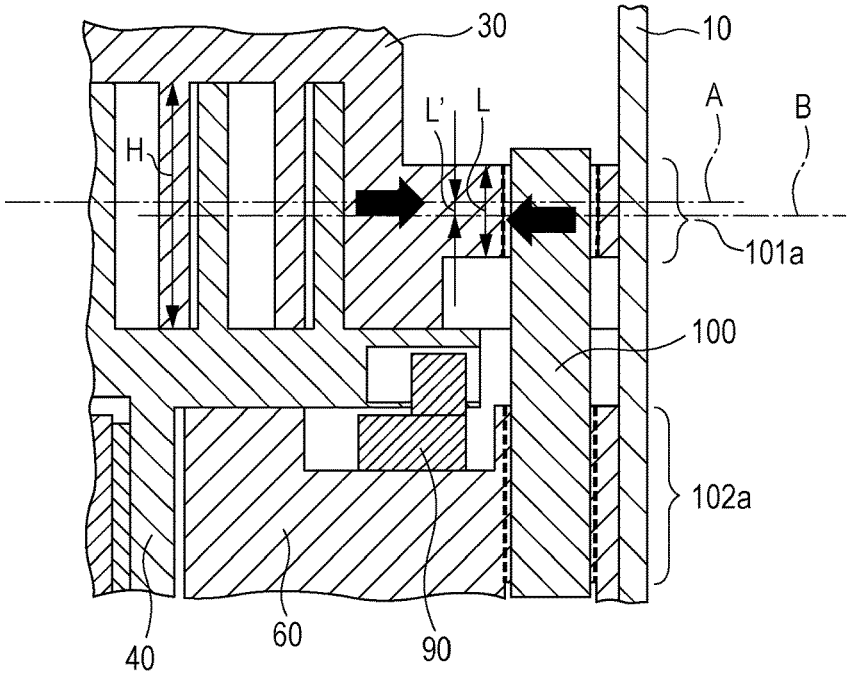
FIG. 11A is a sectional view illustrating positional relationship between the horizontal plane A positioned at the center of the scroll wrap height and horizontal plane B including a coupling point of the sealed scroll compressor according to the exemplary embodiment of the present invention, where the horizontal plane B including the coupling point is near a coupling center.
Figure 11B:
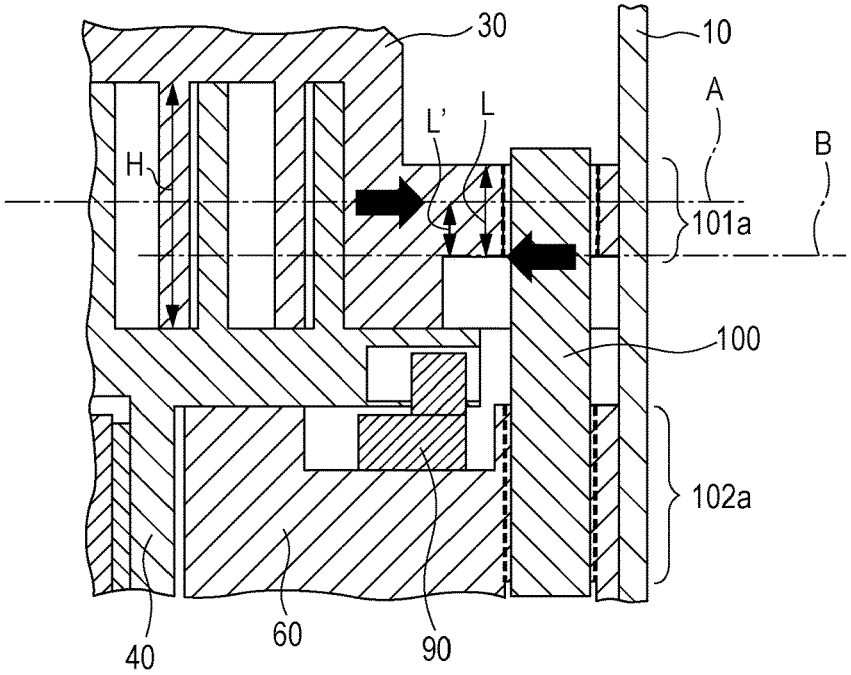
FIG. 11B is a sectional view illustrating positional relationship between the horizontal plane A positioned at a center of the scroll wrap height and the horizontal plane B including the coupling point of the sealed scroll compressor according to the exemplary embodiment of the present invention, where the horizontal plane B including the coupling point is at a coupling edge.

FIG. 11A is a sectional view illustrating positional relationship between horizontal plane A positioned at the center of the scroll wrap height and horizontal plane B including a coupling point of the sealed scroll compressor according to the exemplary embodiment of the present invention, where horizontal plane B including the coupling point is near the coupling center. FIG. 11B is a sectional view illustrating positional relationship between horizontal plane A positioned at the center of the scroll wrap height and horizontal plane B including the coupling point of the sealed scroll compressor according to the exemplary embodiment of the present invention, where horizontal plane B including the coupling point is at a coupling edge.

The sealed scroll compressor according to the exemplary embodiment satisfies relationship expressed by $H/2 \geq L$, where H is a height of a scroll wrap, which is fixed scroll wrap 32 of fixed scroll 30 and L is an axial length of coupling region 101*a* where the upper end of pillar member 100 couples with scroll coupler 101. With this configuration, distance L' between a center of height H of fixed scroll wrap 32 and a touch (contact) point can be kept relatively small, where the resultant of radial and tangential gas forces applied to fixed scroll 30 acts on the center of height H. This is true even when pillar member 100 is positioned with inclination allowed within a clearance of coupling region 101*a* or when the touch (contact) point of pillar member 100 is at the lower end of coupling region 101*a* as illustrated in FIG. 11B due to, for example, deformation during an operation. The overturn of the fixed scroll is further prevented.

The sealed scroll compressor according to the exemplary embodiment further includes suction inlet 38 provided in fixed scroll 30 to provide communication between compression chamber 50 and low-pressure space 12. The relationship expressed by $H \leq R$ is satisfied, where H is a height of a scroll wrap, which is fixed scroll wrap 32 of fixed scroll 30, and R is a minimum distance between a center of main bearing 60 and an outer circumferential portion of a wrap edge of fixed scroll wrap 32 of fixed scroll 30, the outer circumferential portion not overlapping suction inlet 38 in a radial direction when viewed from the center of main bearing 60 (the outer circumferential portion is indicated by solid line 32*d* in FIG. 3). With such a configuration, a large touch (contact) region is created between the edge of fixed scroll wrap 32 of fixed scroll 30 and orbiting scroll 40. Thus, the pressure applied to a back face of fixed scroll 30 presses fixed scroll 30 against orbiting scroll 40 to produce a greater rotational moment that prevents the overturn of fixed scroll 30. Consequently the overturn of fixed scroll 30 is further prevented.

In the sealed scroll compressor according to the exemplary embodiment as illustrated in FIGS. 3 to 5, an inner wall of fixed scroll wrap 32 of fixed scroll 30 extends to a vicinity of wall end 32*b* of orbiting scroll wrap 42 of orbiting scroll 40. This configuration creates difference between trapped volume VA of a compression chamber 50 formed between the inner wall of fixed scroll wrap 32 and an outer wall of orbiting scroll wrap 42 and trapped volume VB of another compression chamber 50 formed between an outer wall of fixed scroll wrap 32 and an inner wall of orbiting scroll wrap 42.

The trapped volume of suctioned gas is thus maximized to raise a pressure ratio. The height of fixed scroll wrap 32 and the height of orbiting scroll wrap 42 can thus be reduced. Fixed scroll 30 can therefore move between partition plate 20 and main bearing 60 in the axial direction. Consequently in the scroll compressor in which sealing between the fixed scroll 30 and orbiting scroll 40 is secured by fixed scroll 30 pushed against orbiting scroll 40 by the pressure in discharge space 30H, fixed scroll 30 is further stabilized with fixed scroll wrap 32 and orbiting scroll wrap 42 having smaller height.

In the exemplary embodiment, a position of suction trap of compression chamber 50 in the trapped volume VA and a position of suction trap of compression chamber 50 in the trapped volume VB are provided near suction inlet 38. This minimizes a passage length for suctioned refrigerant and thereby reduces heat-receiving loss

INDUSTRIAL APPLICABILITY

The present invention is useful for a compressor for a refrigeration cycle device applicable to an electric product, such as a water heater, a hot water heater, and an air conditioner.

REFERENCE MARKS IN THE DRAWINGS

10 sealed container
11 high-pressure space
12 low-pressure space
13 refrigerant suction tube
14 refrigerant discharge tube
15 oil reservoir
16 sub-bearing
17*a*, 17*b* balance weight
20 partition plate
21 second discharge port
22 hole
30 fixed scroll
30H discharge space
30M intermediate pressure space
31 fixed scroll plate
32 fixed scroll wrap
32*b* wall end
32*c* outermost inner wall
32*d* solid line
33 circumferential wall
35 first discharge port
36 bypass port
37 mid-pressure port
38 suction inlet
39 boss
40 orbiting scroll
41 orbiting scroll plate
42 orbiting scroll wrap
43 boss
50 compression chamber
60 main bearing
61 bearing
62 boss house
63 return passage
70 rotation shaft
71 eccentric shaft
72 oil passage
73 suction port
74 paddle
75 oil supply port
76 oil supply port
77 oil supply port
78 swing bush
79 revolve bearing
80 motor unit
81 stator
82 rotor
90 rotation restrictor (oil dam ring)
91 first key groove
92 second key groove
93 first key
94 second key
95 ring
100 pillar member
101 scroll coupler
101*a* coup ling region
102 bearing coupler
102*a* bearing coupling region
121 bypass check valve
122 bypass check valve stopper
131 discharge check valve
132 discharge check valve stopper
141 first seal
142 second seal
150 plugging member
151 ring member
152 projection

The invention claimed is:

1. A scroll compressor comprising:

a partition plate that partitions an inside of a sealed container into a high-pressure space and a low-pressure space;

a fixed scroll adjacent to the partition plate;

an orbiting scroll that meshes with the fixed scroll to form a compression chamber;

a rotation restrictor that prevents rotation of the orbiting scroll;

a main bearing that supports the orbiting scroll;

a bearing coupler provided in the main bearing;

a scroll coupler provided in the fixed scroll; and a single pillar member having a lower end and an upper end, the lower end being inserted in the bearing coupler, the upper end being inserted in the scroll coupler, wherein the fixed scroll, the orbiting scroll, the rotation restrictor, and the main bearing are disposed in the low-pressure space, the fixed scroll and the orbiting scroll are disposed between the partition plate and the main bearing, the lower end of the single pillar member and the bearing coupler are fixed together, and the upper end of the single pillar member and the scroll coupler are coupled together in a manner slidable in an axial direction, a coupling region where the single pillar member couples with the scroll coupler is in intersecting relationship with a horizontal plane positioned at a center of a scroll wrap height of the fixed scroll, the scroll compressor further comprises a suction inlet provided in the fixed scroll to provide communication between the compression chamber and the low-pressure space, and wherein a relationship expressed below is satisfied, where H is the scroll wrap height of the fixed scroll and R is a minimum distance between a center of the main bearing and an outer circumferential portion of a wrap edge of a fixed scroll wrap of the fixed scroll, the outer circumferential portion of the wrap edge of the fixed scroll wrap of the fixed scroll not overlapping the suction inlet in a radial direction when viewed from the center of the main bearing, $$H \leq R.$$

2. The scroll compressor according to claim 1, wherein a relationship expressed below is satisfied, where the H is the scroll wrap height of the fixed scroll and L is an axial length of a coupling region where the upper end of the single pillar member couples with the scroll coupler.

3. The scroll compressor according to claim 1, wherein an inner wall of the fixed scroll wrap of the fixed scroll extends to a vicinity of a wall end of an orbiting scroll wrap of the orbiting scroll to divide the compression chamber into a first chamber and a second chamber, the first chamber being formed between the inner wall of the fixed scroll wrap and an outer wall of the orbiting scroll wrap, the second chamber being formed between an outer wall of the fixed scroll wrap and an inner wall of the orbiting scroll wrap, the first chamber and the second chamber having different trapped volumes.

4. The scroll compressor according to claim 1, wherein the suction inlet is provided on a circumferential wall of the fixed scroll.

5. The scroll compressor according to claim 4, wherein the suction inlet extends in a direction from a first end of the outer circumferential portion of the wrap edge of the fixed scroll to a second end of the outer circumferential portion of the wrap edge of the fixed scroll along the circumferential wall of the fixed scroll.

* * * * *